US010310406B2

(12) United States Patent
Okuno

(10) Patent No.: US 10,310,406 B2
(45) Date of Patent: Jun. 4, 2019

(54) DEVELOPING DEVICE AND IMAGE FORMING APPARATUS INCLUDING A REGULATING MEMBER

(71) Applicant: FUJI XEROX CO., LTD., Tokyo (JP)

(72) Inventor: Taichiro Okuno, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/445,256

(22) Filed: Feb. 28, 2017

(65) Prior Publication Data

US 2018/0059573 A1 Mar. 1, 2018

(30) Foreign Application Priority Data

Sep. 1, 2016 (JP) ..... 2016-171052

(51) Int. Cl.
*G03G 15/08* (2006.01)

(52) U.S. Cl.
CPC ..... *G03G 15/0812* (2013.01); *G03G 15/0887* (2013.01)

(58) Field of Classification Search
CPC ..... G03G 15/0812
USPC ..... 399/272, 254
See application file for complete search history.

(56) References Cited

U.S. PATENT DOCUMENTS

2009/0103952 A1* 4/2009 Sakamoto ..... G03G 15/0879 399/258
2011/0217085 A1* 9/2011 Hattori ..... G03G 15/09 399/254
2011/0318062 A1 12/2011 Hayashi et al.
2012/0003014 A1 1/2012 Nakayama et al.
2012/0219326 A1* 8/2012 Koike ..... G03G 15/0893 399/254

FOREIGN PATENT DOCUMENTS

JP 2012-8257 A 1/2012
JP 2012-14086 A 1/2012

* cited by examiner

*Primary Examiner* — Quana Grainger
(74) *Attorney, Agent, or Firm* — Sughrue Mion, PLLC

(57) ABSTRACT

Provided is a developing device including a developer carrier that holds developer, a supply member that supplies the developer to the developer carrier while agitating the developer, a transport member that is disposed obliquely upward in a vertical direction of the supply member, delivers and transports the developer with agitating the developer through a passageway portion provided at each end portion in an axial direction of the supply member, and a regulating member that is provided at a position corresponding to the passageway portion that delivers the developer from the supply member to the transport member, to regulate movement of the developer from the supply member to the developer carrier.

20 Claims, 6 Drawing Sheets

DEVELOPING DEVICE AND IMAGE FORMING APPARATUS INCLUDING A REGULATING MEMBER

CROSS-REFERENCE TO RELATED APPLICATIONS

This application is based on and claims priority under 35 USC 119 from Japanese Patent Application No. 2016-171052 filed Sep. 1, 2016.

BACKGROUND

Technical Field

The present invention relates to a developing device and an image forming apparatus.

SUMMARY

According to an aspect of the invention, there is provided a developing device including:

a developer carrier that holds developer;

a supply member that supplies the developer to the developer carrier while agitating the developer;

a transport member that is disposed obliquely upward in a vertical direction of the supply member, delivers and transports the developer with agitating the developer through a passageway portion provided at each end portion in an axial direction of the supply member; and a regulating member that is provided at a position corresponding to the passageway portion that delivers the developer from the supply member to the transport member, to regulate movement of the developer from the supply member to the developer carrier.

BRIEF DESCRIPTION OF THE DRAWINGS

Exemplary embodiments of the present invention will be described in detail based on the following figures, wherein.

DETAILED DESCRIPTION

Hereinafter, an exemplary embodiment of the present invention will be described with reference to the drawings.

First Exemplary Embodiment

Figure 1:
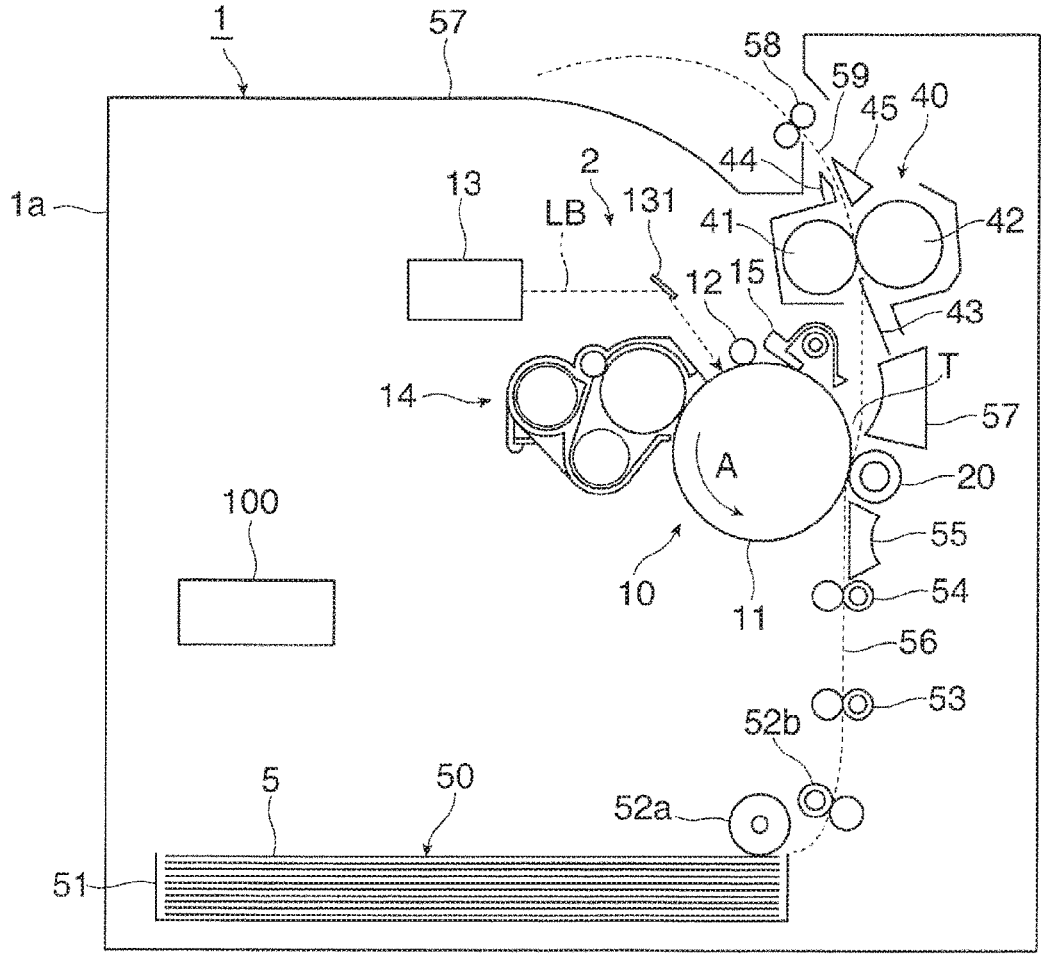
FIG. 1 is a schematic configuration diagram illustrating an image forming apparatus to which a developing device according to a first exemplary embodiment of the present invention is applied.
Figure 2:
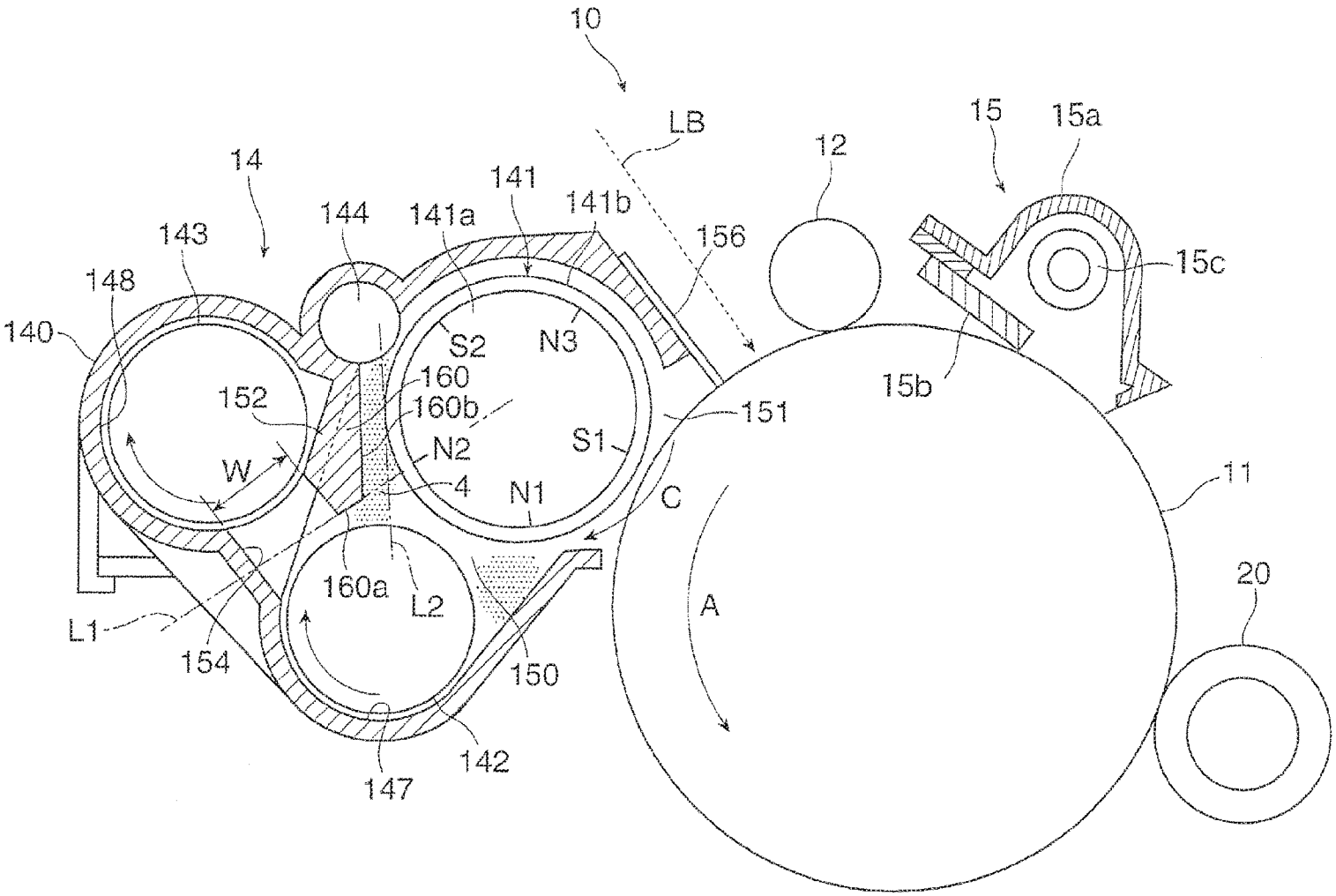
FIG. 2 is a configuration diagram illustrating an image forming unit of the image forming apparatus according to the first exemplary embodiment of the present invention.

FIGS. 1 and 2 are configuration diagrams each illustrating an image forming apparatus to which a developing device according to a first exemplary embodiment of the present invention is applied. FIG. 1 illustrates an outline of the entire image forming apparatus, and FIG. 2 illustrates a main part (an image forming device and the like) of the image forming apparatus in an enlarged diagram.

<Entire Configuration of Image Forming Apparatus>

For example, an image forming apparatus 1 according to a first exemplary embodiment is configured as a monochrome printer. The image forming apparatus 1 includes an image forming unit 2 as an example of an image forming unit for forming an image on a recording medium based on image data.

The image forming unit 2 includes: an image forming device 10 that forms a toner image developed by a toner that constitutes developer; a transfer device 20 that transfers the toner image formed by the image forming device 10 to a recording sheet 5 as an example of a recording medium; a sheet feeding device 50 that accommodates and transports predetermined recording sheets 5 to be supplied to a transfer position T of the transfer device 20; and a fixing device 40 that fixes the toner image on the recording sheet 5 transferred by the transfer device 20. Further, in FIG. 1, reference numeral 1*a* indicates an image forming apparatus main body, which is formed as a support structure member, or an external cover. In addition, the broken line in the drawing indicates a main transport path along which the recording sheet 5 is transported in the image forming apparatus main body 1*a*.

The image forming device 10 includes a single image forming device that exclusively forms a toner image of black K. The image forming device 10 is disposed at a predetermined position in the vicinity of a side wall at one side (the right side in the illustrated drawings) in an internal space of the image forming apparatus main body 1*a*.

As illustrated in FIG. 1, the image forming device 10 includes a photoconductor drum 11 as an example of a rotating image carrier, and the following devices are mainly disposed around the photoconductor drum 11. The main devices include: a charging device 12 that charges a circumferential surface (an image carrying surface) of the photoconductor drum 11, on which an image may be formed, with a predetermined electric potential; an exposure device 13 as an example of an electrostatic latent image forming unit that forms an electrostatic latent image having a potential difference by irradiating the charged circumferential surface of the photoconductor drum 11 with light LB based on information (a signal) of an image; a developing device 14 as an example of a developing unit that forms a toner image by developing the electrostatic latent image by using the toner of the developer of black K; a drum cleaning device 15 that cleans the image carrying surface of the photoconductor drum 11 by removing attached substances such as toner remaining on and attached to the image carrying surface of the photoconductor drum 11 after the transfer is performed; and the like.

The photoconductor drum 11 is obtained by forming an image carrying surface having a photoconductive layer (photosensitive layer) made of a photosensitive material on the circumferential surface of a cylindrical or columnar base material that is grounded. The photoconductor drum 11 is supported to be rotatable in a direction indicated by an arrow A by a power transmitted from a driving device (not illustrated).

The charging device 12 includes a contact charging device that includes a charging roller disposed in a state of being in contact with the photoconductor drum 11. A charging voltage is applied to the charging device 12 by a charging high-voltage power source. In a case in which the developing device 14 performs reverse development, a voltage or electric current, which has a polarity identical to the charging polarity of the toner supplied from the developing device 14, is supplied as the charging voltage.

The exposure device 13 forms an electrostatic latent image by irradiating the circumferential surface of the photoconductor drum 11 with light (a broken arrow line) LB, which is formed according to the information of an image input to the image forming apparatus 1 via a mirror 131 after the circumferential surface of the photoconductor drum 11 is charged. When a latent image is to be formed, information (signal) of an image input to the image forming apparatus 1 by an arbitrary unit is transmitted to the exposure device 13.

As illustrated in FIG. 2, the developing device 14 is configured by disposing, within an apparatus housing (case) 140 that is formed with an opening and an accommodation chamber for developer 4, a developing roller 141 that holds the developer 4 and transports the developer 4 to a developing region that faces the photoconductor drum 11, a supply transport member 142 and an agitation transport member 143 such as screw augers (not illustrated) which agitate the developer 4 and transport the developer 4 so that the developer 4 passes over the developing roller 141, a flat plate-shaped partition wall 152 that partitions an interior into a first accommodation chamber 147 that accommodates the supply transport member 142 and a second accommodation chamber 148 that accommodates the agitation transport member 143, and a layer thickness regulating member 144 that regulates the amount (a layer thickness) of the developer 4 held on the developing roller 141. Developing voltage is supplied from a power source (not illustrated) between the developing roller 141 of the developing device 14 and the photoconductor drum 11. In addition, the developing roller 141, the supply transport member 142, and the agitation transport member 143 are rotated in predetermined directions by a power transmitted from the driving device (not illustrated). In addition, a two-component developer including non-magnetic toner and a magnetic carrier is used as the developer 4. Further, the developing device 14 will be described below in detail.

As illustrated in FIG. 1, the transfer device 20 is a contact transfer device including a transfer roller that rotates while being in contact with the circumferential surface of the photoconductor drum 11 at the transfer position T, and is supplied with a transfer voltage. As the transfer voltage, a direct current voltage having a polarity opposite to the charging polarity of the toner is supplied from a power source (not illustrated).

As illustrated in FIG. 2, the drum cleaning device 15 includes a cleaning plate 15*b* that is disposed in a container-shaped main body 15*a* and cleans the photoconductor drum 11 by removing attached substances such as residual toner, and a transport member 15*c* such as a screw auger (not illustrated) that transports the attached substances collected by the cleaning plate 15*b* to an external collecting container. A plate-shaped member (e.g., a blade) made of a material such as rubber is used as the cleaning plate 15*b*.

As illustrated in FIG. 1, the fixing device 40 is configured by disposing a roll type or belt type heating rotating body 41 heated by a heating unit so that a surface temperature is maintained to a predetermined temperature, and a roll type or belt type pressurizing rotating body 42 which rotates in a state of being in contact with the heating rotating body 41 with a predetermined pressure. In the fixing device 40, a contact portion where the heating rotating body 41 and the pressurizing rotating body 42 are in contact with each other is a fixing processing portion where a necessary fixing process (heating and pressing processes) is performed.

The sheet feeding device 50 is disposed to be present at a position in the lower side of the image forming apparatus main body 1*a*. The sheet feeding device 50 mainly includes: a single (or plural) sheet accommodating body 51 that accommodates recording sheets 5 having a desired size and type in a state in which the recording sheets 5 are stacked, and delivery devices 52*a* and 52*b* that send out the recording sheets 5 one by one from the sheet accommodating body 51. For example, the sheet accommodating body 51 is mounted to be withdrawn to a front side of the image forming apparatus main body 1*a* (a side facing a user when the user manipulates the sheet accommodating body 51).

Between the sheet feeding device 50 and the transfer device 20, a sheet feeding transport path 56 is provided which includes plural sheet transport roller pairs 53 and 54 and a transport guide 55 that transport a recording sheet 5 sent out from the sheet feeding device 50 to the transfer position T. The sheet transport roller pair 54 disposed immediately before the transfer position T in the sheet feeding transport path 56 is configured as, for example, a roll (registration roller) that adjusts transport timing of the recording sheet 5.

At the downstream side of the transfer device 20, a transport guide 57 is disposed to transport the recording sheet 5, to which the toner image is transferred by the transfer device 20, to the fixing device 40. In addition, in the inlet of the fixing device 40, an inlet guide member 43 is provided to guide the recording sheet 5 to the fixing processing portion where the heating rotating body 41 and the pressurizing rotating body 42 are in contact with each other, and in the outlet of the fixing device 40, outlet guide members 44 and 45 are provided to guide the recording sheet 5 which has been subjected to the fixing processing.

At the downstream side of the fixing device 40, a sheet discharge transport path 59 is provided that includes sheet discharge rollers 58 that discharges the recording sheet 5 having a toner image fixed thereon by the fixing device 40 to a sheet discharge unit 57 disposed at an upper side of the image forming apparatus main body 1*a*.

In FIG. 1, reference numeral 100 indicates a control device that collectively controls the operations of the image forming apparatus 1. The control device 100 is provided with a non-illustrated central processing unit (CPU), read only memory (ROM), or random access memory (RAM), or a bus, a communication interface, and the like that connect the CPU, the ROM, and the like.

<Basic Operation of Image Forming Apparatus>

Hereinafter, a basic image forming operation by the image forming apparatus 1 will be described.

An image forming operation at the time of forming a monochrome image, which is formed from the toner image of black K, by using the image forming device 10, will be described.

When the image forming apparatus 1 receives command information requesting an image forming operation (print), the image forming device 10, the transfer device 20, and the fixing device 40 are started.

In the image forming device 10, the photoconductor drum 11 rotates in the direction indicated by the arrow A first, and the charging device 12 charges the surface of the photoconductor drum 11 with a predetermined polarity (in the first exemplary embodiment, negative polarity) and electric potential. Subsequently, the exposure device 13 irradiates the surface of the photoconductor drum 11 with light LB emitted based on a signal of an image input to the image forming apparatus 1, after the surface of the photoconductor drum 11 is charged, to form an electrostatic latent image configured by a predetermined potential difference on the surface.

Subsequently, the developing device 14 performs the development for the electrostatic latent image formed on the photoconductor drum 11 by supplying the toner charged with a predetermined polarity (negative polarity) to the electrostatic latent image so that the toner is electrostatically attached to the electrostatic latent image. With this development, the electrostatic latent image formed on the photoconductor drum 11 is visualized as the toner image developed by the toner.

Subsequently, when the toner image formed on the photoconductor drum 11 of the image forming device 10 is transported to the transfer position T, the transfer device 20 transfers the toner image to the recording sheet 5.

In addition, in the image forming device 10 in which the transfer is terminated, the drum cleaning device 15 cleans the surface of the photoconductor drum 11 by scraping and removing attached substances such as the toner remaining on the surface of the photoconductor drum 11. Therefore, the image forming devices 10 is in a state in which the next image forming operation is capable of being performed.

Meanwhile, the sheet feeding device 50 sends out the predetermined recording sheet 5 to the sheet feeding transport path 56 in accordance with the image forming operation. In the sheet feeding transport path 56, the sheet transport roller pair 54 serving as registration rollers sends out the recording sheet 5 to be supplied to the transfer position T in accordance with the transfer timing.

Subsequently, the recording sheet 5 having the toner image transferred thereon is transported to the fixing device 40 via the transport guide 57. In the fixing device 40, a predetermined fixing process (heating and pressing processes) is performed to fix the unfixed toner image to the recording sheet 5 by causing the recording sheet 5 after the transfer to be introduced into and pass through the fixing processing portion between the rotating heating rotating body 41 and the pressurizing rotating body 42 through the inlet guide member 43. Finally, after the fixing is completed, the recording sheet 5 is discharged by the sheet discharge rollers 58 to, the sheet discharge unit 57 provided, for example, at the upper side of the image forming apparatus 1 through the sheet discharge transport path 59.

With the above described operation, the recording sheet 5 is output in a state in which a monochrome image is formed on one side of the recording sheet 5.

<Configuration of Developing Device>

FIG. 2 is a cross-sectional configuration diagram illustrating the developing device according to the first exemplary embodiment together with other constituent members of the image forming device.

As illustrated in FIG. 2, the developing device 14 is provided with the apparatus housing 140 as an example of a developer accommodating container. Within the apparatus housing 140, a developer accommodation chamber 150 is formed to accommodate the two-component developer 4. An opening 151 is formed in a region of the apparatus housing 140 which faces the photoconductor drum 11. In addition, within the apparatus housing 140, the developing roller 141 as an example of a developer carrier is rotatably disposed in an arrow direction C to be partially exposed through the opening 151. The developing roller 141 includes a magnet roller 141*a*, as an example of a magnetic field generating member, which is fixedly disposed therein and includes magnetic poles each having a predetermined polarity and disposed at predetermined positions in a circumferential direction thereof, and a cylindrical developing sleeve 141*b*, as an example of a developer transport member, which is disposed on the outer circumference of the magnet roller 141*a* to be rotatable at a predetermined rotational speed along the arrow direction C. The developing sleeve 141*b* is made of a non-magnetic material such as aluminum or non-magnetic stainless steel in a cylindrical shape.

In this exemplary embodiment, a rotation direction of the developing sleeve 141*b* is set to a direction reverse to a rotation direction of the photoconductor drum 11. That is, as illustrated in FIG. 2, while the rotation direction of the photoconductor drum 11 is set to the counterclockwise direction, the rotation direction of the developing sleeve 141*b* is set to a clockwise direction. As a result, the outer circumferential surface of the developing sleeve 141*b* is moved in the same direction as the direction in which the surface of the photoconductor drum 11 is moved, in the developing region facing the photoconductor drum 11. In addition, the rotation direction of the developing sleeve 141*b* may be set to the same direction as the rotation direction of the photoconductor drum 11.

The magnet roller 141*a* includes: a developing magnetic pole S1, which is disposed at a position slightly displaced from a position closest to the photoconductor drum 11 to an upstream side in the rotation direction of the photoconductor drum 11 in a developing region facing the photoconductor drum 11; a pick-off magnetic pole N1, which is positioned at the downstream side in the rotation direction of the developing sleeve 141*b* to separate the developer 4 used to develop the image from the surface of the developing sleeve 141*b*, and transport the separated developer 4 into the apparatus housing 140; a pick-up magnetic pole N2 which is disposed at the downstream side of the pick-off magnetic pole N1 in the rotation direction of the developing sleeve 141*b* to adsorbs the developer 4 to the surface of the developing sleeve 141*b*; a trimming magnetic pole S2 that uniformizes the adsorbed developer 4 on the surface of the developing sleeve 141*b* by the layer thickness regulating member 144; and a transport magnetic pole N3, which is disposed at the downstream side of the trimming magnetic pole S2 in the rotation direction of the developing sleeve 141*b* to transport the uniformized developer 4 to the developing region. In the vicinity of the upstream side of the trimming magnetic pole S2 of the magnet roller 141*a*, the layer thickness regulating member 144 is disposed to regulate the amount (layer thickness) of the developer 4 held on the surface of the developing sleeve 141*b*. The layer thickness regulating member 144 is made of a columnar magnetic material, and regulates the layer thickness of the developer 4 to a predetermined value in a state in which the magnetic force of the trimming magnetic pole S2 is applied. The developer 4 transported while being adsorbed by the magnetic poles of the magnet roller 141*a* is formed as a layer in the form of a magnetic brush shape on the surface of the developing sleeve 141*b*.

Within the apparatus housing 140, the supply transport member 142 is disposed obliquely downward in the vertical direction at the rear side of the developing roller 141, in which the supply transport member 142 includes a screw auger (supply auger) or the like that draws up the developer 4 accommodated in (the bottom portion of) the developer accommodation chamber 150, and supplies the developer 4 to the developing roller 141. The supply transport member 142 is rotated clockwise by a driving device (not illustrated). In addition, in the apparatus housing 140, the agitation transport member 143 is disposed obliquely upward in the vertical direction at the rear side (the opposite side to the photoconductor drum 11) of the supply transport member 142, in which the agitation transport member 143 includes a screw auger (admix auger) that transports the developer 4 and supplies the developer 4 into the apparatus housing 140 while agitating the developer 4. As a result, the agitation transport member 143 is present at a position in an approximately horizontal direction at the rear side of the developing roller 141. While the agitation transport member 143 is also rotated by the driving device (not illustrated), the rotation direction of the agitation transport member 143 may be either of the clockwise direction and the counterclockwise direction. In the illustrated example, the rotation direction of the agitation transport member 143 is set to the clockwise direction.

In the exemplary embodiment, as illustrated in FIG. 2, the agitation transport member 143 is disposed obliquely upward in the vertical direction at the rear side of the supply transport member 142. For this reason, in the developing device 14, the depth of the apparatus housing 140 is set to be small and the apparatus housing 140 is miniaturized compared to a case in which the agitation transport member 143 is disposed in the horizontal direction at the rear side of the supply transport member 142.

In the apparatus housing 140, the first accommodation chamber 147 and the second accommodation chamber 148 are provided to accommodate the supply transport member 142 and the agitation transport member 143, in which the first accommodation chamber 147 and the second accommodation chamber 148 are formed in a substantially semi-cylindrical or substantially cylindrical shape in cross section. The first accommodation chamber 147 and the second accommodation chamber 148 are partitioned by the partition wall 152 provided in the apparatus housing 140. Further, in the illustrated example, for convenience, the apparatus housing 140 is illustrated as being integrally formed. Of course, however, the apparatus housing 140 may be configured by being divided into an upper housing (not illustrated) and a lower housing (not illustrated).

Figure 3:
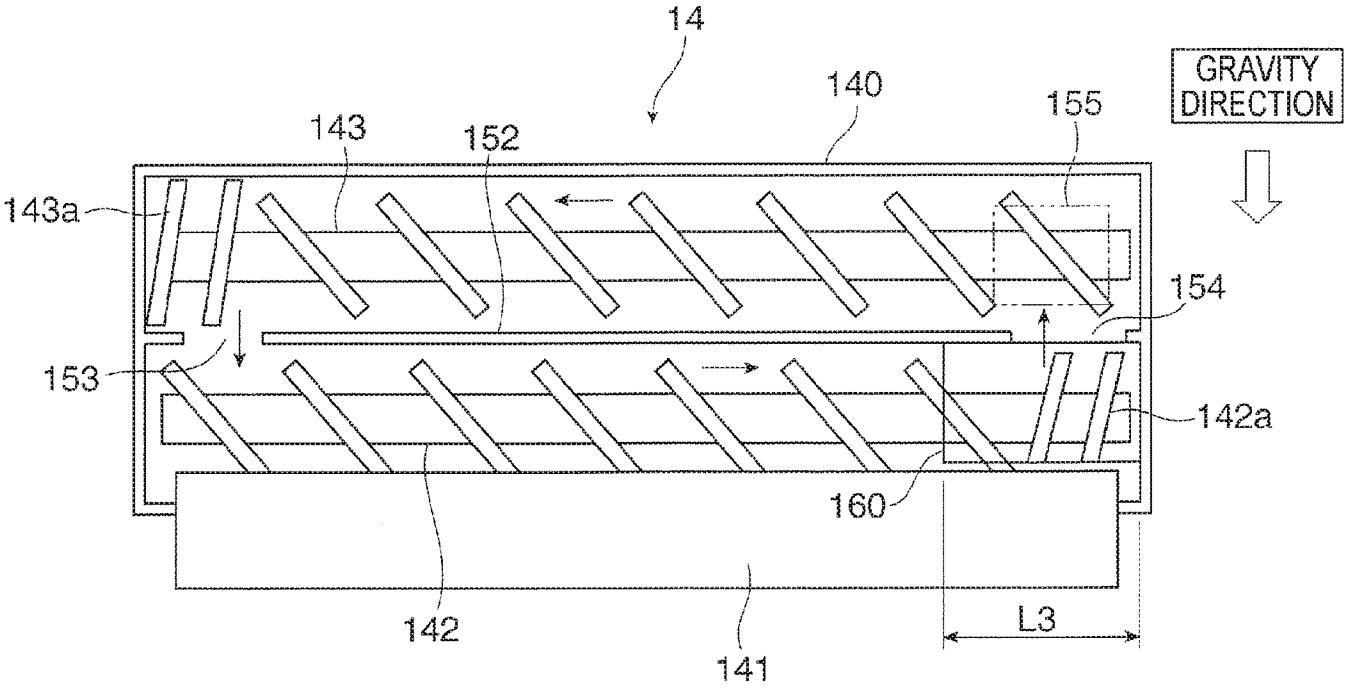
FIG. 3 is a schematic configuration diagram illustrating the developing device according to the first exemplary embodiment of the present invention.

In addition, as illustrated in FIG. 3, at opposite end portions of the partition wall 152 in the longitudinal direction, first and second passageway portions 153 and 154 are formed respectively to deliver the developer 4 between the supply transport member 142 and the agitation transport member 143. In addition, in the apparatus housing 140, a supply port 155 is opened at the upstream side end portion of the agitation transport member 143 in the transport direction, in which the supply port supplies the developer 4 including at least the toner from a toner cartridge (not illustrated). Further, the supply port 155 may also be provided at a portion where the agitation transport member 143, together with the apparatus housing 140, extends to one side (right side in FIG. 3) in the axial direction of the agitation transport member 143.

The developer 4, which is supplied into the apparatus housing 140 from the supply port 155, is agitated with the developer 4 accommodated in the apparatus housing 140 while the developer 4 is transported by the agitation transport member 143. When the developer 4, which is transported while being agitated by the agitation transport member 143, is transported to the end portion of the downstream side in the transport direction of the agitation transport member 143, the developer 4 is delivered to the supply transport member 142 through the first passageway portion 153 opened in the partition wall 152. In addition, at the downstream side end portion of the agitation transport member 143 in the transport direction, a short reverse transport blade 143*a* is provided to deliver the developer 4 from the first passageway portion 153 to the supply transport member 142 while pushing the developer 4 transported by the agitation transport member 143 back to the upstream side.

The developer 4, which is delivered to the supply transport member 142, is supplied to the developing roller 141 positioned obliquely upward while the developer 4 is transported by the supply transport member 142. In addition, the developer 4, which is transported to the downstream side end portion of the supply transport member 142 in the transport direction, is delivered to the supply transport member 142 positioned obliquely upward through the second passageway portion 154 opened in the partition wall 152. In addition, at the downstream side end portion of the supply transport member 142 in the transport direction a short reverse transport blade 142*a* is provided to deliver the developer 4 from the second passageway portion 154 to the agitation transport member 143 while pushing the developer 4 transported by the supply transport member 142 back to the upstream side.

By the way, as illustrated in FIG. 2, in the developing device 14 according to the exemplary embodiment, the agitation transport member 143 is disposed obliquely upward in the vertical direction at the rear side of the supply transport member 142. For this reason, it is required to deliver the developer 4, which is transported to the downstream side in the transport direction by the supply transport member 142, to the agitation transport member 143 positioned obliquely upward in the vertical direction against the gravity through the second passageway portion 154.

Figure 4:
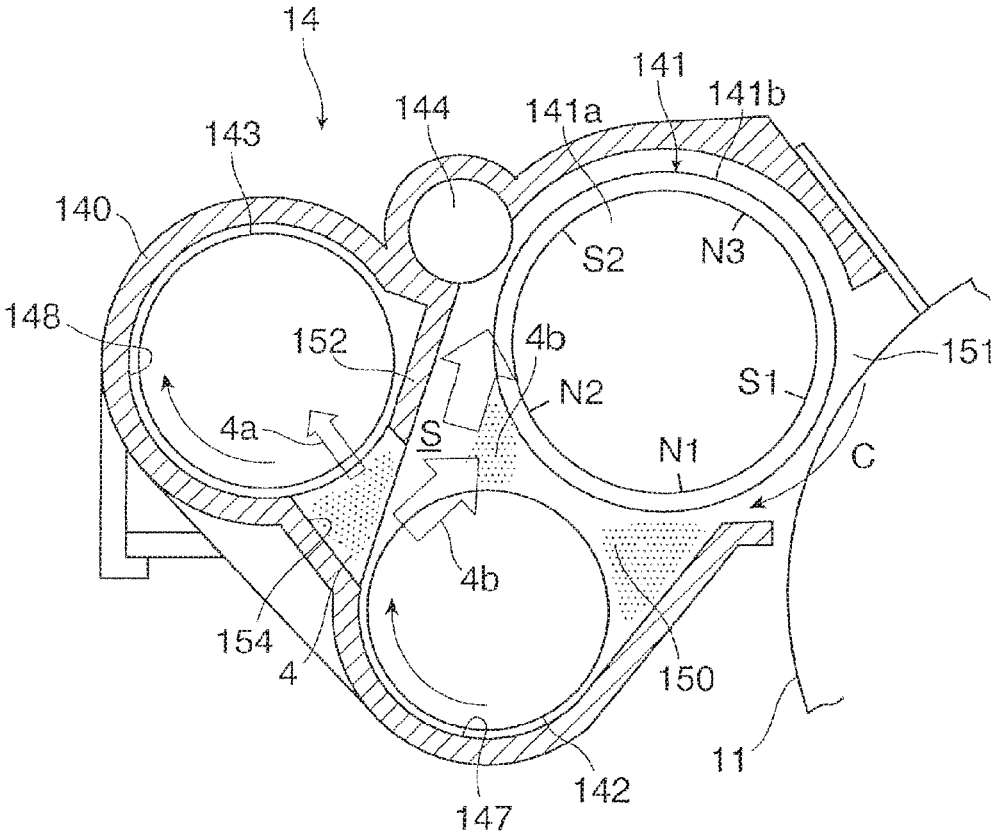
FIG. 4 is a configuration diagram illustrating the developing device before the exemplary embodiment is applied.

As a result, as illustrated in FIG. 4, the developer 4, which is transported to the agitation transport member 143 positioned obliquely upward in the vertical direction by the supply transport member 142, easily stays in the region of the second passageway portion 154 due to an influence of gravitational force. Although a part 4*a* of the developer 4 is transported from the second passageway portion 154 to the agitation transport member 143, a large amount of staying developer 4*b* flows from the supply transport member 142 into the developing roller 141. Then, a developer holding amount per unit area of the surface of the developing roller 141 (hereinafter, referred to as "MOS") ($g/m^2$) is increased at the end portion of the developing roller 141 which is positioned at the second passageway portion 154 side.

Therefore, there is a concern that in the developing device 14, the MOS may increase at the downstream side in the transport direction of the supply transport member 142, the MOS may not be uniform in the axial direction of the developing roller 141, and density irregularity may be caused in the axial direction of the developing roller 141.

Therefore, in the developing device 14 according to the exemplary embodiment, as illustrated in FIG. 2, a regulating member 160 that regulates the movement of the developer 4 from the supply transport member 142 to the developing roller 141 is provided at a position corresponding to the second passageway portion 154 that transports the developer 4 from the supply transport member 142 to the agitation transport member 143. The regulating member 160 is provided integrally with the apparatus housing 140, or configured as a component separate from the apparatus housing 140, and mounted at a predetermined position of the apparatus housing 140. Further, in the illustrated exemplary embodiment, the regulating member 160 is provided integrally with the apparatus housing 140.

As illustrated in FIG. 3, the regulating member 160 is provided to have a predetermined length L3 from the upstream side to the downstream side in the transport direction of the supply transport member 142 in the second passageway portion 154, at the position corresponding to the second passageway portion 154. The regulating member 160 includes a protrusion formed by making the inner wall surface of the partition wall 152, which partitions the supply transport member 142 and the agitation transport member 143 in the apparatus housing 140, protrude toward the supply transport member 142 side and the developing roller 141 side. As illustrated in FIG. 4, the movement of the developer 4 from the supply transport member 142 to the developing roller 141 is regulated by burying a space S (dead space) formed between the supply transport member 142 and the developing roller 141.

The regulating member 160 is configured so that a side surface 160*a* positioned at the supply transport member 142 side is positioned on an extension line L1 in the radial direction of the pick-up magnetic pole N2 of the magnet roller 141*a*. In addition, in the regulating member 160, a side surface 160*b* positioned at the developing roller 141 side is positioned in parallel with a tangential line L2 at an intermediate position between the pick-up magnetic pole N2 and the trimming magnetic pole S2 of the developing roller 141.

As illustrated in FIG. 2, the region in which the regulating member 160 is provided corresponds to the outside of the pick-up magnetic pole N2 of the magnet roller 141*a* in the radial direction. In a case in which the space S formed between the supply transport member 142 and the developing roller 141 by the regulating member 160 is set to be excessively narrow, there is a concern that the amount of the developer 4 supplied from the supply transport member 142 to the developing roller 141 is reduced, and on the contrary, the MOS ($g/m^2$) in the region of the developing roller 141, which corresponds to the second passageway portion 154, is decreased. Therefore, the arrangement and the protruding amount of the regulating member 160 including the length thereof and the like may be preferably set such that the MOS ($g/m^2$) becomes substantially uniform in the axial direction of the developing roller 141.

In the developing device 14, an opening width (gap) W of the second passageway portion 154 may be set to be larger than that of the first passageway portion 153, as necessary.

In FIG. 2, reference numeral 156 indicates a seal member made of a synthetic resin film to seal a portion between the apparatus housing 140 and the outer circumferential surface of the photoconductor drum 11.

<Operation of Characteristic Part of Developing Device>

Figure 5:
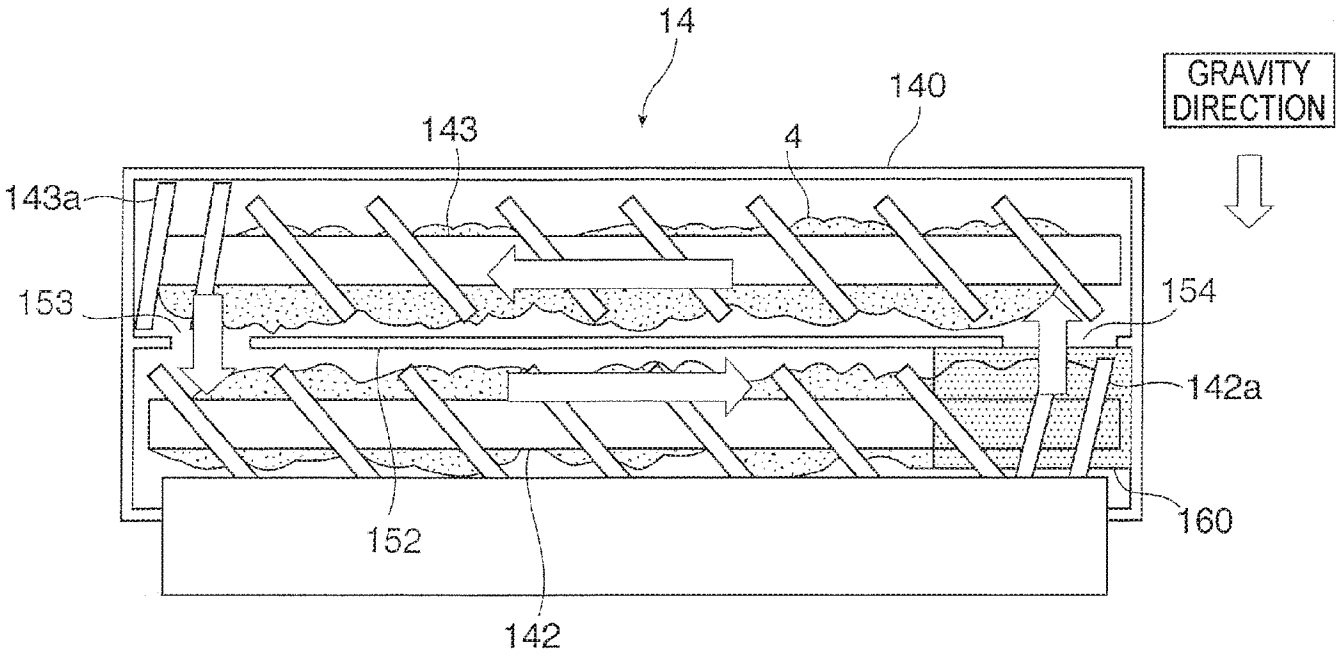
FIG. 5 is a schematic configuration diagram illustrating an operation of the developing device according to the first exemplary embodiment of the present invention.

As illustrated in FIG. 2, in the developing device 14 according to the first exemplary embodiment, the developing roller 141, the supply transport member 142, and the agitation transport member 143 are rotated at a predetermined rotational speed by the driving device (not illustrated) when the electrostatic latent image formed on the surface of the photoconductor drum 11 is developed. As illustrated in FIG. 5, the developer 4 accommodated in the apparatus housing 140 is transported to the downstream side in the axial direction of the agitation transport member 143 while being agitated by the agitation transport member 143.

Thereafter, the developer 4 is delivered from the agitation transport member 143 to the supply transport member 142 through the first passageway portion 153. The developer 4, which is delivered to the supply transport member 142, is supplied to the developing roller 141 while being transported by the agitation transport member 143, and provided for the development. The developer 4, which is transported to the downstream side end portion of the supply transport member 142 in the axial direction, is delivered from the supply transport member 142 to the agitation transport member 143 through the second passageway portion 154.

Figure 6:
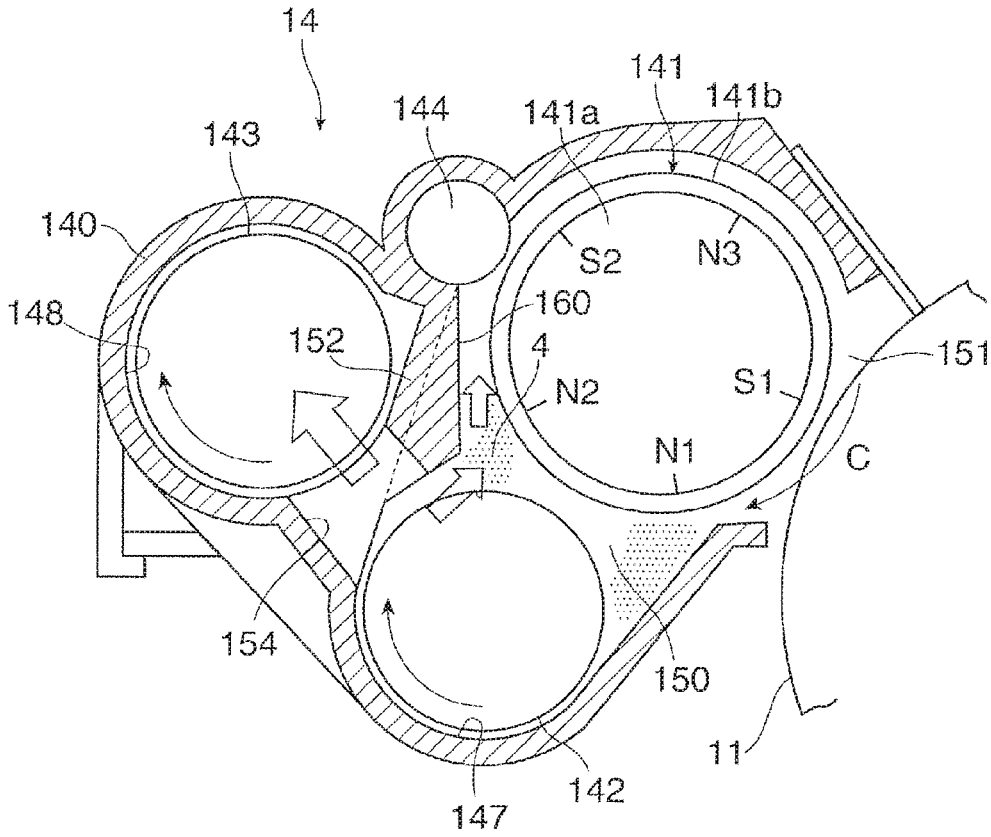
FIG. 6 is a schematic configuration diagram illustrating an operation of the developing device according to the first exemplary embodiment of the present invention.

In that event, as illustrated in FIG. 5, the regulating member 160 is provided in a region corresponding to the second passageway portion 154 to regulate the movement of the developer 4 from the supply transport member 142 to the developing roller 141 side. For this reason, as illustrated in FIG. 6, while a part of the developer 4, which is delivered from the supply transport member 142 to the agitation transport member 143 through the second passageway portion 154, moves to the developing roller 141, the majority of the developer 4 moves to the agitation transport member 143 through the second passageway portion 154. Therefore, it is inhibited that the developer 4 is excessively supplied in the region of the developing roller 141 which corresponds to the second passageway portion 154 and that density irregularity is occurred along the axial direction of the developing roller 141.

As illustrated in FIG. 2, because the side surface 160*a* of the regulating member 160, which is positioned at the supply transport member 142 side, is positioned on the extension line L1 in the radial direction of the pick-up magnetic pole N2 of the magnet roller 141*a*, the absorption of the developer 4 to the developing roller 141 is effectively inhibited by the pick-up magnetic pole N2. In addition, because the side surface 160*b* of the regulating member 160 located at the side of the developing roller 141 is positioned in parallel with the tangential line L2 positioned at an intermediate position between the pick-up magnetic pole N2 and the trimming magnetic pole S2 of the developing roller 141, the developer 4 moving from the supply transport member 142 to the developing roller 141 is effectively regulated along the magnetic brush of the developer 4 which is formed by the pick-up magnetic pole N2 and the trimming magnetic pole S2.

The exemplary embodiment has been described as being applied to the monochrome image forming apparatus, but the exemplary embodiment may, of course, be equally applied to a color image forming apparatus having plural image forming devices.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a developer carrier configured to hold developer;

a supply member configured to supply the developer to the developer carrier while agitating the developer;

a transport member that is disposed obliquely upward in a vertical direction of the supply member, a partition member configured to partition the supply member from the transport member, wherein the transport member is configured to deliver and transport the developer while agitating the developer through a passageway portion provided at each end portion in an axial direction of the supply member; and wherein the partition member comprises a regulating member that is provided at a position corresponding to the passageway portion, wherein the passageway portion is configured to deliver the developer from the supply member to the transport member, wherein the regulating member is configured to regulate movement of the developer from the supply member to the developer carrier, and wherein the developing device is configured such that separated developer from a surface of the developer carrier is transported to the supply member.

2. The developing device according to claim 1, wherein the regulating member blocks a space formed between the supply member and the developer carrier to regulate the movement of the developer from the supply member to the developer carrier.

3. The developing device according to claim 1, wherein the developer carrier includes a cylindrical developer transport member and a magnetic field generating member that is fixedly disposed in the developer transport member and has a plurality of magnetic poles, and a side surface of the regulating member positioned at a side of the supply member is positioned on an extension line in a radial direction of a pick-up magnetic pole of the magnetic field generating member.

4. The developing device according to claim 2, wherein the developer carrier includes a cylindrical developer transport member and a magnetic field generating member that is fixedly disposed in the developer transport member and has a plurality of magnetic poles, and a side surface of the regulating member positioned at a side of the supply member is positioned on an extension line in a radial direction of a pick-up magnetic pole of the magnetic field generating member.

5. The developing device according to claim 1, wherein a side surface of the regulating member positioned at a side of the developer carrier is positioned in parallel with a tangent line of the developer carrier.

6. The developing device according to claim 2, wherein a side surface of the regulating member positioned at a side of the developer carrier is positioned in parallel with a tangent line of the developer carrier.

7. The developing device according to claim 3, wherein a side surface of the regulating member positioned at a side of the developer carrier is positioned in parallel with a tangent line of the developer carrier.

8. The developing device according to claim 4, wherein a side surface of the regulating member positioned at a side of the developer carrier is positioned in parallel with a tangent line of the developer carrier.

9. The developing device according to claim 1, wherein a length of the regulating member in an axial direction of the supply member is set to be larger than an opening width of the passageway portion.

10. The developing device according to claim 2, wherein a length of the regulating member in an axial direction of the supply member is set to be larger than an opening width of the passageway portion.

11. The developing device according to claim 3, wherein a length of the regulating member in an axial direction of the supply member is set to be larger than an opening width of the passageway portion.

12. The developing device according to claim 4, wherein a length of the regulating member in an axial direction of the supply member is set to be larger than an opening width of the passageway portion.

13. The developing device according to claim 1, wherein the regulating member has a protrusion that protrudes toward the supply member from an inner surface of a developer accommodation chamber that accommodates the developer.

14. The developing device according to claim 2, wherein the regulating member has a protrusion that protrudes toward the supply member from an inner surface of a developer accommodation chamber that accommodates the developer.

15. The developing device according to claim 3, wherein the regulating member has a protrusion that protrudes toward the supply member from an inner surface of a developer accommodation chamber that accommodates the developer.

16. The developing device according to claim 4, wherein the regulating member has a protrusion that protrudes toward the supply member from an inner surface of a developer accommodation chamber that accommodates the developer.

17. An image forming apparatus comprising:

an image carrier configured to hold an electrostatic latent image; and a developing unit configured to develop the electrostatic latent image held by the image carrier, wherein the developing device according to claim 1 is used as the developing unit.

18. An image forming apparatus comprising:

an image carrier configured to hold an electrostatic latent image; and a developing unit configured to develop the electrostatic latent image held by the image carrier, wherein the developing device according to claim 2 is used as the developing unit.

19. An image forming apparatus comprising:

an image carrier configured to hold an electrostatic latent image; and a developing unit configured to develop the electrostatic latent image held by the image carrier, wherein the developing device according to claim 3 is used as the developing unit.

20. An image forming apparatus comprising:

an image carrier configured to hold an electrostatic latent image; and a developing unit configured to develop the electrostatic latent image held by the image carrier, wherein the developing device according to claim 4 is used as the developing unit.

* * * * *